United States Patent [19]

Petrovec et al.

[11] 4,146,999

[45] Apr. 3, 1979

[54] ACOUSTICAL PANEL WITH RIGIDIFIED EDGES

[76] Inventors: David C. Petrovec, 2154 Wantagh Park Dr., Wantagh, N.Y. 11793; Philip M. Petrovec, 2 Stewart Ct., Baldwin, N.Y. 11510

[21] Appl. No.: 805,288

[22] Filed: Jun. 10, 1977

[51] Int. Cl.[2] ..... E04B 1/82

[52] U.S. Cl. ..... 52/145; 181/191; 181/192

[58] Field of Search ..... 52/144, 145, 222, 601, 52/624, 627; 181/284, 290, 291, 292

[56] References Cited

U.S. PATENT DOCUMENTS

| | | | |
|---|---|---|---|
| 2,022,161 | 11/1935 | Spafford | 52/145 |
| 2,192,653 | 3/1940 | Schenk | 52/145 |
| 2,802,764 | 8/1957 | Slayter | 181/291 |
| 3,111,188 | 11/1963 | Rees | 52/144 |
| 3,608,264 | 9/1971 | Jones | 52/144 |
| 3,748,799 | 7/1973 | Tough | 52/144 |
| 3,822,762 | 7/1974 | Crispin | 81/292 |

FOREIGN PATENT DOCUMENTS

| | | | |
|---|---|---|---|
| 590510 | 4/1959 | Italy | 181/290 |
| 276057 | 6/1951 | Switzerland | 52/485 |
| 469667 | 7/1937 | United Kingdom | 52/144 |
| 835340 | 5/1960 | United Kingdom | 181/284 |

*Primary Examiner*—Ernest R. Purser
*Assistant Examiner*—Henry Raduazo
*Attorney, Agent, or Firm*—Albert F. Kronman

[57] ABSTRACT

An acoustical panel formed of a core of sound-attenuating material having a front and a back surface. The edges of the core are resin-hardened for rigidification. The core is covered by a fabric stretched over its front surface adhered to the hardened edges and to the back surface. A board cover is fixed on the back surface over the core and the ends of the fabric.

In other versions of the invention, the core is reinforced by having its edges encased in a frame to which it is secured by the resin. The fabric is stretched over the frame and core thereby forming an air gap between the fabric and the core which improves the acoustical efficiency of the panel and masks the outline of the frame. High-impact-resistant channel members of different shapes constitute the frame.

4 Claims, 6 Drawing Figures

FIG. 1
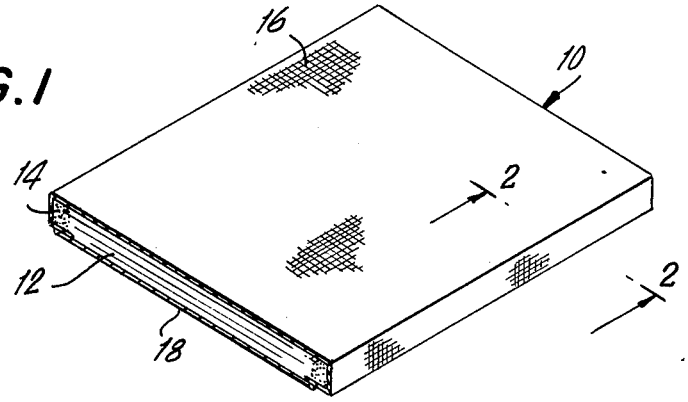
FIG. 3
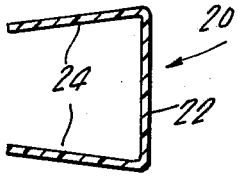
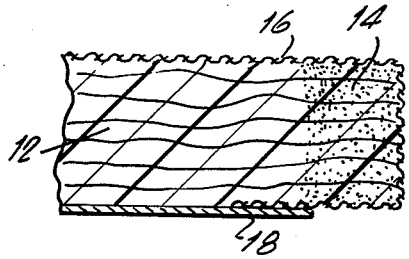
FIG. 2
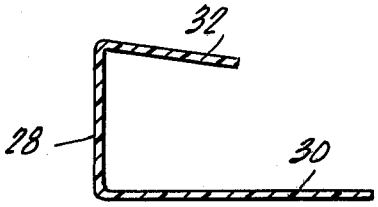
FIG. 4
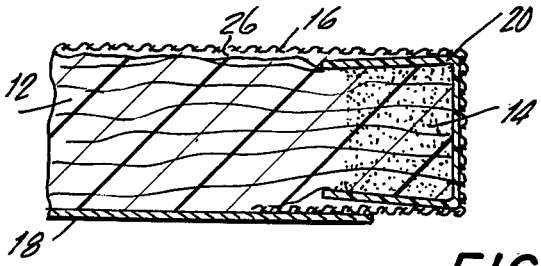
FIG. 5
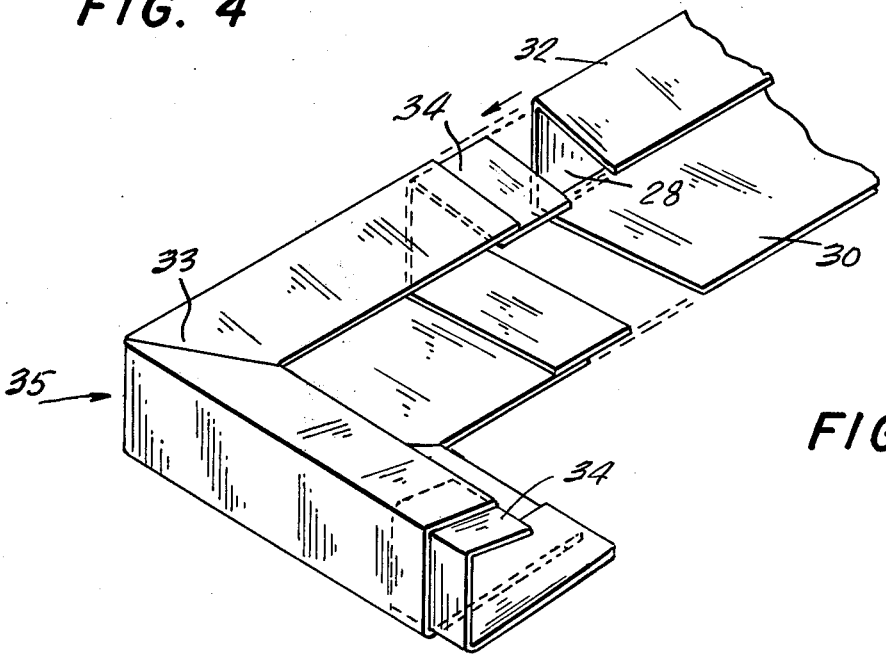
FIG. 6

ACOUSTICAL PANEL WITH RIGIDIFIED EDGES

BACKGROUND OF THE INVENTION

1. Field of the Invention

This invention relates to a novel acoustical panel construction having rigidified edges and improved sound-attenuating characteristics. Such panels can be mounted to walls or to ceilings and can be used in floor to ceiling partitioning.

2. The Prior Art

The prior art, exemplified by U.S. Pat. No. 4,010,817, is generally illustrative of panels or tiles of this type. However, the mechanical structure, composition and manufacturing procedures used in the prior art produce a heavy, unstable article which creates various field problems including breakage on impact and warping. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a device or article of this character which combines simplicity, strength and durability in a high degree, together with inexpensiveness of construction.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

Brief Description of the Drawing

In the accompanying drawing there are shown various embodiments of this invention, wherein like reference characters identify the same or like parts:

FIG. 1 is a perspective view showing a panel constructed in accordance with the invention;

FIG. 2 is a cross-section through an edge of the panel depicted in FIG. 1, taken on line 2—2;

FIGS. 3 and 4 are end views of channel members used in forming the frame for other embodiments of the invention;

FIG. 5 is a cross-section through an edge of a panel assembled with channels illustrated in FIG. 3.

FIG. 6 is a somewhat isometric exploded view of a channel and corner assembly useful in the present invention.

With reference to the drawing, there is shown in FIG. 1 an acoustical panel constructed in accordance with the principles of the invention and designated generally by reference character 10. In its broadest embodiment shown in FIGS. 1 and 2, the panel 10 includes a core 12 formed of a suitable sound-attenuating material such as mineral wool but preferably made of fiberglass. The core 12 can have a thickness of one to two inches or more and a density of three to six pounds per cubic feet.

The edges of core 12 are provided with an impregnant consisting of a quick setting resin the viscosity of which enables it to penetrate the core material to a suitable depth. Preferably, such impregnation is achieved by dipping the core into a resin solution. The resin upon setting, forms a strip of natural rigidified material 14 along the periphery of the core. Once the resin has hardened, the edges are smoothed by sanding. The front of the core is then covered by placing thereon sound absorbing screen material such as a fabric 16, of any desired pattern, texture or color. The fabric is brought around to the rear surface of the core and secured thereto by adhesive as shown in FIG. 2. About one and a half inches of fabric is disposed along the edge of the back surface. The ends are butt jointed, heat welded and sealed.

An 18, 22 or 24 pound printers board or chip board 18 is then secured with an adhesive to the back surface of the assembly and overlying the ends of the fabric 16. This board serves as a dress up, as a dust cover, a flat smooth surface for mounting articles, and in some cases a gluing surface.

Various mounting means (not shown) can be used to secure the panel 10 in place such as by panel adhesive applied to its edges or the surface of the board 18, two sided pressure sensitive tape, hook and loop fasteners, or rubberized magnetic tape. For ceiling suspended panels, a line suspension system or a chain system similar to that used with swag lamps is suitable. To erect floor to ceiling partitioning, deep "U" shaped channels are secured to the floor or "H" shaped channels can be used extending from floor to ceiling into which the panels of the invention are inserted in abutting relation.

The resin used to form the hardened strips 14 of the core 12 is a quickly setting and hardenable impregnant such as a thermosetting resin, for example, that marketed by the Marco Chemical Div. of Grace Chemical Co. under the designation GR 12200. This resin is a preaccelerated, unsaturated, styrenated polyester resin promoted with methylethyl ketone and 0.5 to 1.0% of peroxide in dimethyl phthalate. The resin hardens at 77° to 90° F. in a half-hour. Aluminum trihydrate or other gel formers can be added to the resin to increase its viscosity, if it is desired, for example, to rigidify and square up the edges of the core.

Another hardenable impregnant useful for the purpose of this invention is a fast drying rubber based adhesive such as that sold by Childers Products Co. under the designation C P 85.

The panels of the invention can be further reinforced and modified by not only providing a rigidifying resin impregnant coating on the edges of the core but by also securing to the edges corner-connected elongated channel members of extruded, high impact resistant plastic such as polystyrene.

FIG. 3 shows in cross section one such channel member 20 consisting of a vertical web 22 and spaced converging legs 24 integral with and joined by the vertical web 22. The converging disposition of the legs exerts pressure on the core 12 to produce a mechanical union between the core and the channel. A partial view of a panel made with this type of a channel is shown in FIG. 5.

In making the panel, the edges of core 12 are dipped in the resin or impregnant until the resin is sufficiently imbibed therein. The channels are applied to the core edges and additional resin is injected between the core and the channels. The channels may be mitered at the four corners and heat welded to form a frame encasing the panel. Alternately, prewelded mitered corners 33, best shown in FIG. 6, may be provided to receive the ends of the channels. Fabric 16 is then fitted as before over the core and the channel members. The resulting assembly provides an air gap 26 between the inner surface of the fabric and the front surface of the core 12. Air gap 26 improves the acounstical efficiency of the panel.

FIG. 4 shows another channel member 28 useful in the present invention. The channel also has converging legs extending from a common vertical web member 28 but one leg 30 is longer than the other leg 32. Typically, the short leg will measure one inch and the other will measure 1¾ inch. Channels of this type will be assembled using the corner pieces 35 with recessed lips 34 at both ends as shown in FIG. 6. The lip will slip into the channel which is heat welded thereto.

The longer leg of this channel 33 will accept a greater variety of mechanical fasteners for flush mounting of panels to walls than the channels which have legs of the same length.

The panels of the invention have been thoroughly tested under actual use conditions and have been found to be completely successful for the accomplishment of the above stated objects of the invention.

The operation and use of the invention hereinabove described will be evident to those skilled in the art to which it relates.

From a consideration of the foregoing, it will be seen that there are provided articles in which the several objects of this inention are achieved, and which are adapted to meet the conditions of practical use.

As various possible embodiments might be made of the above invention and as various changes might be made in the embodiment above set forth, it is to be understood that all matter herein set forth or shown in the accompanying drawing is to be interpreted as illustrative and not in a limiting sense.

Having thus described my invention, I claim as new and desired to be secured by Letters Patent:

1. An acoustical panel comprising a core of sound attenuating material having a front major surface and a back major surface, said core having edges rigidified by a hardenable impregnant imbibed therein to form a strip of rigid material along the periphery of said core; a fabric coating (stretched over said front major surface and) substantially coextensive with the said entire front surface; (said fabric extending beyond said edges); high-impact resistant channels secured to said edges and connected together at their corners to form a reinforcing frame for said panel; said fabric being stretched over said channels members thereby forming a sound attenuating air gap between the inner surface and the front major surface of said core within said panel; and a board member disposed upon and covering the ends of said fabric and back major surface of the core.

2. The invention as defined in claim 1, wherein the hardenable impregnant is a thermo-setting resin.

3. The invention as defined in claim 1, wherein the hardenable impregnant is a rubber based adhesive.

4. The invention as defined in claim 1, wherein said core has a density of 3 to 6 pounds per cubic feet.

* * * * *